US008585397B2

(12) United States Patent
Guillou et al.

(10) Patent No.: US 8,585,397 B2
(45) Date of Patent: Nov. 19, 2013

(54) HOT AIR GENERATOR

(75) Inventors: Yves Guillou, Chelles (FR); Christophe Le Drappier, Pantin (FR)

(73) Assignee: Guilbert Express (FR)

( * ) Notice: Subject to any disclaimer, the term of this patent is extended or adjusted under 35 U.S.C. 154(b) by 1033 days.

(21) Appl. No.: 12/567,052

(22) Filed: Sep. 25, 2009

(65) Prior Publication Data

US 2010/0081105 A1 Apr. 1, 2010

(30) Foreign Application Priority Data

Sep. 26, 2008 (FR) ..... 08 56484

(51) Int. Cl.
*F27D 19/00* (2006.01)

(52) U.S. Cl.
USPC ..... 432/47; 431/38; 431/12; 431/43; 431/47; 431/264; 431/153; 431/345; 431/344; 431/328; 431/329; 431/268; 431/255; 431/256; 34/90; 34/96; 34/97; 34/98; 34/99; 34/100; 34/551; 165/8; 165/9; 165/10; 137/7; 137/505.42; 48/107; 432/222; 432/219; 126/401; 126/414; 126/403; 126/405; 126/406

(58) Field of Classification Search
USPC ..... 432/47, 222, 219; 122/1 A; 165/8–10; 392/384; 34/96–100, 551, 90; 126/401–407, 413; 431/153, 255, 256, 431/264, 268, 344, 345, 328, 329, 38; 137/505.42
See application file for complete search history.

(56) References Cited

U.S. PATENT DOCUMENTS

| | | | | |
|---|---|---|---|---|
| 3,917,442 | A * | 11/1975 | Zagoroff | 431/351 |
| 4,082,497 | A | 4/1978 | Crawford et al. | |
| 4,798,530 | A | 1/1989 | Sestrap | |
| 5,297,733 | A * | 3/1994 | Burks et al. | 239/85 |
| 5,649,824 | A | 7/1997 | Stagg et al. | |
| 2006/0260692 | A1 * | 11/2006 | Pechtold | 137/505.42 |
| 2009/0197212 | A1 * | 8/2009 | Masen | 431/12 |

FOREIGN PATENT DOCUMENTS

| | | |
|---|---|---|
| EP | 0841518 | 5/1998 |
| EP | 1795803 A2 | 6/2007 |
| EP | 2037174 A1 | 3/2009 |

OTHER PUBLICATIONS

Search Report from corresponding French Application No. 0856484, mailed Feb. 19, 2010.

* cited by examiner

*Primary Examiner* — Kang Hu
*Assistant Examiner* — Nathaniel Herzfeld
(74) *Attorney, Agent, or Firm* — Lerner, David, Littenberg, Krumholz & Mentlik, LLP

(57) ABSTRACT

A hot air generator comprising a handle (12), an elongated nozzle (14), flame generating means (6), a venturi (4), a gas conduit (162) intended to bring a combustible gas into the elongated nozzle (14) and at the flame generating means (6), an air conduit (164) intended for bringing compressed air into the elongated nozzle (14) and downstream from the venturi; characterized in that the generator further comprises a servo-controlled pressure regulator (2) controlling a gas pressure ($P_{d.g}$) in the gas conduit (162) depending on an air pressure ($P_{d.a}$) in the air conduit (164).

15 Claims, 4 Drawing Sheets

HOT AIR GENERATOR

CROSS REFERENCE TO RELATED APPLICATIONS

This application claims the benefit of French Patent Application No. 0856484, filed on Sep. 26, 2008, in the French Patent Office, the entire disclosure of which is incorporated herein by reference.

BACKGROUND OF THE INVENTION

The invention relates to a hot air generator.

A hot air generator generally appears as an elongated body longitudinally crossed by a conduit in which flows gas to be inflamed. The body is extended by a generally hollow burner portion into which opens the conduit. The burner portion is provided at its free end with gas combustion means capable of setting fire to the gas. Such a burner is for example described in document EP 1 795 803.

More generally, it may be used for heating thermosetting, thermoformable, heat-shrinkable materials, materials which are caused to adhere by heat and the like.

For example, such a hot generator is advantageously used for laying or making asphalt.

It may also be used in the construction field by roofers for covering roofs with thermosetting impervious material, which is generally found in the form of wound strips.

The generator may further be used in the field of logistics and transportation for shrinking plastic films surrounding pallets of goods.

The generator may also be used for heating premises.

Although the generator described in document EP 1 795 803 is satisfactorily efficient, changes in the legislation relating to the use of such hand generators recommend the use of hot air generators with no apparent flame.

A solution in order to comply with the new legislation is to project compressed air to be heated towards the flame when the latter is generated inside a hot air generator so that it cannot emerge, in order to transfer calories to the compressed air which flows out of the generator in a hot condition. Thus, the material to be heated is not in contact with the flame but with hot air.

This solution has the drawback of generating a high cost of use for a large consumption of compressed air.

Another drawback lies in safety because gas may be transported into the burner even if there is no longer any compressed air therein.

BRIEF DESCRIPTION OF THE INVENTION

An object of the invention is therefore to propose a burner with which it is possible to reduce the consumption of compressed air and to prevent gas from being brought into the generator without any air.

Another object is to propose such a handy hot air generator.

To this aim, the invention proposes a portable hot air generator comprising:

- a handle comprising ignition means;
- an elongated nozzle bound to the handle comprising an outlet end for ejecting hot air;
- means for generating a flame inside the elongated nozzle;
- a venturi upstream from the flame generating means, formed on the elongated nozzle;
- a gas conduit crossing the handle and intended to bring combustible gas into the elongated nozzle and at the flame generating means;

- an air conduit crossing the handle and intended to bring compressed air into the elongated nozzle and upstream from the venturi;
- characterized in that the generator further comprises a servocontrolled pressure regulator controlling gas pressure in the gas conduit depending on air pressure in the air conduit.

An advantage of such a hot air generator is that as the gas outlet is under the control of the air outlet, the safety of the hot air generator is increased, since gas outflow is avoided in the absence of air outflow.

Other optional and non-limiting features are:

- the flame generating means comprise a tube placed in the nozzle, a burner and a gas injector, the tube is positioned at least partly around the burner and intended to divide a fresh air flow into two;
- the tube is a necked tube, the section of the necked tube being narrowed at its portion closest to the outlet end of the nozzle;
- the gas injector comprises a bore, having the same axis as the nozzle, for inserting the burner, and at least one orifice through which the gas flows out, this/these orifice (s) being positioned so that the gas flows out tangentially to the burner;
- the burner is a burner with a stabilized flame, i.e. the generated flame remains fixed in the same location;
- the stabilized flame burner is either a burner stabilized by a wake effect or a Coanda burner;
- the ignition means are a piezo-electric igniter coupled to an electrically conducing wire in contact with it and which extends up to the flame generating means;
- the servocontrolled pressure regulator comprises a control chamber in fluid communication with the air conduit and downstream from an air expansion chamber, a high pressure gas chamber and a gas expansion chamber in fluid communication with the gas conduit, characterized in that the control chamber is separated from the gas expansion chamber by a varying member which moves or deforms in response to a pressure difference between pressure prevailing in the control chamber and pressure prevailing in the gas expansion chamber, a first stress member opposing the movement or deformation of the varying member when the latter moves or deforms towards the gas expansion chamber;
- the varying member is a disc moving translationally in response to the pressure difference between the pressure prevailing in the control chamber and the pressure prevailing in the gas expansion chamber, the disc having on its edges an O-ring gasket with which sealing between the control chamber and the gas expansion chamber may be ensured;
- the varying member is a membrane which deforms in response to the pressure difference between the pressure prevailing in the control chamber and the pressure prevailing in the gas expansion chamber, the membrane having sealably fixed edges on a wall of the control and gas expansion chambers;
- the servocontrolled pressure regulator further comprises a second stress member adapted so as to generate a pressure offset between the pressure prevailing in the control chamber and the pressure prevailing in the gas expansion chamber;
- the second stress member is a second spring provided in the control chamber and intended to generate an offset so that the gas pressure in the gas conduit is always larger by a substantially constant amount than the air pressure in the air conduit;

the second spring has a supporting point with fixed height in the control chamber and is intended to generate a substantially constant offset;

the second spring has a supporting point with variable height in the control chamber and is intended to generate a variable offset;

the second stress member is a second spring provided in the gas expansion chamber and intended to generate an offset so that the gas pressure in the gas conduit is always less by a substantially constant amount than the air pressure in the air conduit; and the gas injector further comprises an inner toric space in fluid communication with the gas conduit, the inner diameter of which is larger than the diameter of the bore, one or more through-orifices putting the toric space in fluid communication with the inside of the nozzle, on a surface turned towards the outlet end of the nozzle, the bore, the toric space and the nozzle substantially having the same axis.

BRIEF DESCRIPTION OF THE DRAWINGS

Other features, purposes and advantages will become apparent upon reading the following description and with reference to the drawings given as an illustration and not as a limitation, wherein.

DETAILED DESCRIPTION OF THE INVENTION

Hot Air Generator

Figures 1A, 1B:
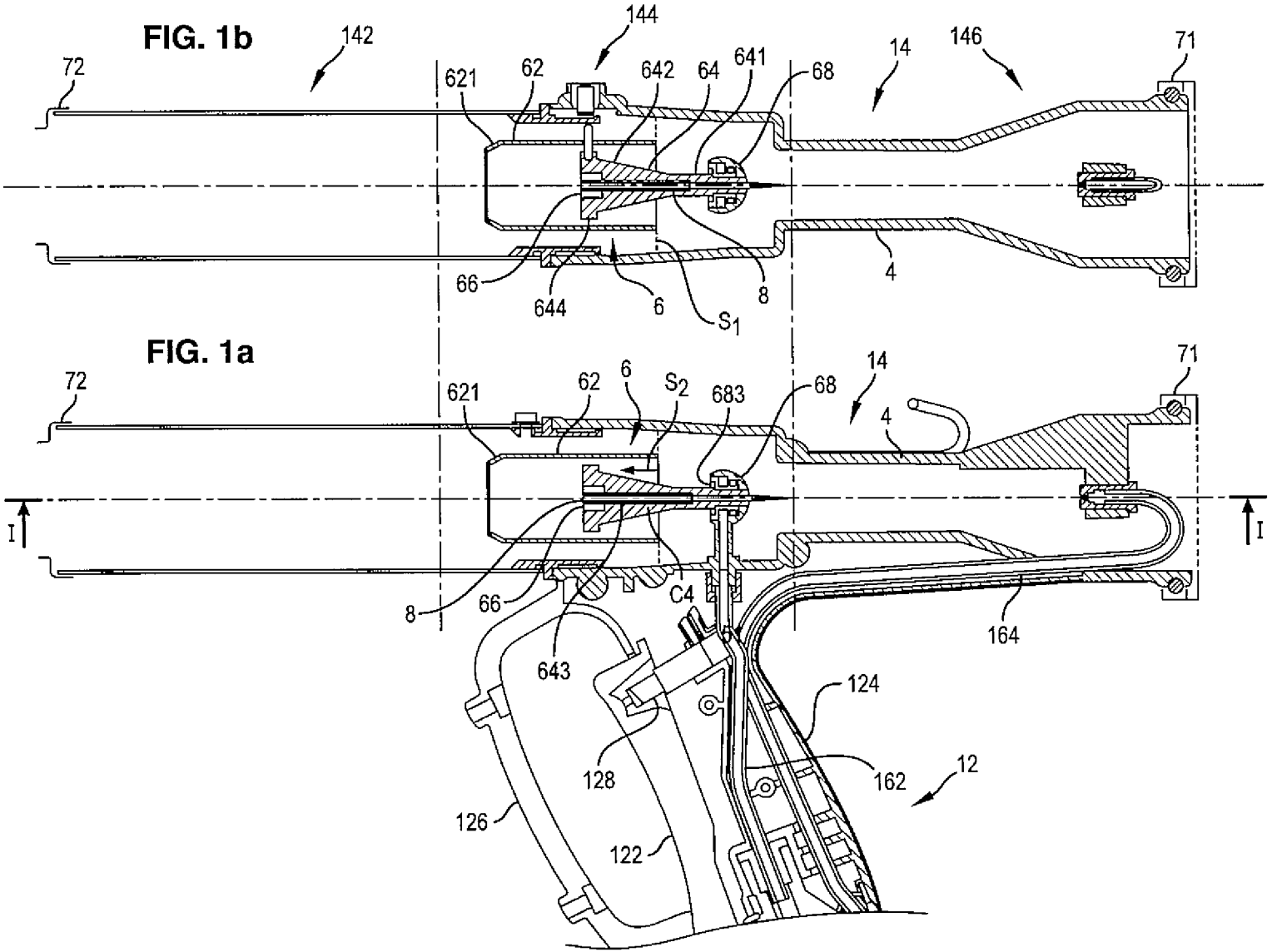
FIG. 1*a* is a schematic longitudinal sectional view of a hot air generator according to the invention.
FIG. 1*b* is a schematic longitudinal sectional view of the hot air generator along the sectional plane I-I of FIG. 1*a*.

With reference to FIGS. 1*a* and 1*b*, a hot air generator 1 according to the invention comprises a handle 12, bound to an elongated nozzle 14 and with a generally circular section. This hot air generator 1 is intended to generate hot air and to project it out of the nozzle 14 at one of its axial ends called an outlet end.

Handle

The handle 12 comprises an actuation lever 122, a grip member 124 and a loop 126. The grip member 124 is connected to the nozzle 14 substantially at half-length of the nozzle 14 and substantially perpendicularly.

The actuation lever 122 is arranged on the grip member 124 at a low portion, so as to be able to perform limited pivoting or translational movement relatively to the grip member 124 bringing it closer to the latter. The lower portion of the grip member 124 is understood as the farthest portion away from the elongated nozzle 14. The actuation lever 122 is engaged, i.e. it pivots or translationally moves, when an operator exerts a force thereon directed towards the grip member 124, in order to enable intake of air and gas.

A stress member enables the actuation lever 122 to be brought back to its starting position, i.e. before the pivoting or translation induced by the stress exerted by the operator.

One end of the loop 126 is connected to the high portion of the grip member 124 and another end of the loop 126 is connected to the low portion of the grip member 124. The high portion of the grip member 124 is the portion which is located closest to the nozzle 14. Between both of these ends, the loop 126 moves away from the grip member 124 thereby forming an opening.

Elongated Nozzle

The elongated nozzle 14 has front and rear ends which are free, the front end being the outlet end. It also has front 142, central 144 and rear 146 portions. The terms <<front>>, <<central>> and <<rear>> are determined according to the outflow of hot air. The front portion 142 is the portion which is closest to the hot air outlet while the rear portion 146 is the portion farthest from the hot air outlet.

At the rear portion 146, the nozzle has a cross-section which varies between at least two different surface area values, the largest being the one located closest to the rear end of the nozzle 14 forming a venturi 4 between the rear end and the central portion 144 used for accelerating non-compressed fresh air entering through the rear end of the nozzle 14.

For example, the cross-section of the elongated nozzle 14 is gradually reduced and then increased.

With the venturi, it is possible to reduce the consumption of compressed air in comparison with a hot air generator which does not have one and which only uses compressed air for generating hot air.

A wind protection component 71 may be fitted on the rear end of the elongated nozzle 14. For example, this protection may be a perforated cover which closes on the rear end by a clip-on, clamping or screwing attachment.

On the front end of the elongated nozzle 14, a shape adapter 72 may be adapted by a clip-on, clamping or screwing attachment. This adapter enables the end to be varied conformably to the use made of the hot air generator 1.

At the central portion 144, flame generating means 6 which will be detailed later on in the following, are arranged inside the nozzle 14.

Gas and Air Supply

In order to bring gas for feeding the flame and air for generating hot air and enabling combustion of the gas, two gas 162 and air 164 conduits are provided. These conduits enter through the lower portion of the gripping member 124, and extend through this member 124 in order to end up in the nozzle 14.

The gas conduit 162 extends towards the front of the nozzle 14 up to its central portion 144. It is connected to a gas source. The gas source may for example be a cylinder of compressed gas, a compressor. The gas conduit 162 opens out into a gas injector 68. This gas injector 68 is substantially positioned at the centre of a section of the nozzle 14 and oriented parallel to the central median axis of the latter, towards the front.

The air conduit 164 extends towards the rear of the nozzle 14, beyond the venturi 4 in order to form a bend so that its endpiece is substantially positioned at the centre of a section of the nozzle 14 and oriented parallel to the central median axis of the latter, towards the front. It is connected to a source of compressed air, for example a cylinder of compressed air. The compressed air flows out of the endpiece through an air injector.

Servocontrolled Pressure Regulator

The supply of the gas conduit 162 is controlled by the pressure prevailing in the compressed air conduit 164 via en servocontrolled pressure regulator 2.

With reference to FIGS. 2*a*, 2*b*, 2*c* and 2*d*, several embodiments of the servocontrolled pressure regulator 2 are described hereafter.

Figure 2A:
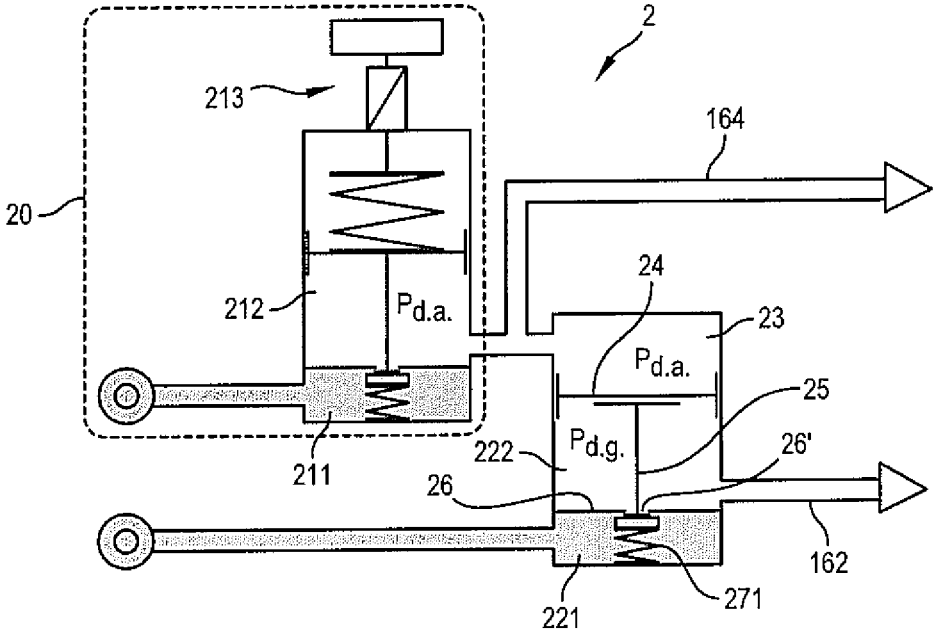
FIGS. 2*a*, 2*b*, 2*c* and 2*d* are schematic views of means for regulating a gas flow/air flow ratio used in the hot air generator according to first, second, third and fourth embodiments.

The servocontrolled pressure regulator 2 illustrated in FIG. 2*a* comprises a control chamber upstream portion 20. The control chamber upstream portion 20 may be made in different ways known to one skilled in the art. It will therefore not be described in detail in the following. It comprises i.a. a high pressure air chamber 211, an air expansion chamber 212 and adjustment means 213. The control chamber upstream chamber 20 delivers at its outlet compressed air at a reduced pressure relatively to the incoming air pressure. The reduced pressure of the air is variable by means of adjustment means 213.

The servocontrolled pressure regulator 2 further comprises a control chamber 23 downstream from the air expansion chamber 212, a high pressure gas chamber 221 and a gas expansion chamber 222.

The control chamber 23 is separated from the gas expansion chamber 222 by a varying member 24 with which the expansion pressure of the gas may be varied in the gas expansion chamber 222 depending on the expansion pressure of the air in the control chamber 23.

This varying member 24 may be a disc which moves translationally in response to a pressure difference between the expansion pressures of the air and of the gas. The disc on its edges has an O-ring gasket with which the seal between the control chamber 23 and the gas expansion chamber 222 may be ensured.

A membrane, the edges of which are sealably attached to the wall of the control 23 and gas expansion 222 chambers, may also be used. This membrane deforms according to the pressure difference between the air and gas expansion pressures.

The gas expansion chamber 222 is separated from the high pressure gas chamber 221 by a separation wall 26.

The separation wall 26 comprises an orifice 26'. An H-shaped valve 25 is positioned between the gas expansion chamber 222 and the high pressure gas chamber 221 through the orifice 26'. A first shank of the H-shape valve 25 is positioned just below the varying member 24.

Alternatively, the first shank of the valve 25 is directly bound to the varying member 24. Still alternatively, the varying member 24 forms the first shank of the valve 25.

A stress member 271 acts on the other shank of the H-shaped valve 25 in order to oppose displacement or deformation of the varying member of the control chamber 23 towards the gas expansion chamber 222.

The stress member 271 may be a spring attached to a wall of the high pressure gas chamber 221 opposite to the separation wall 26 facing the orifice 26'.

The size of the orifice 26' is less than the size of the shanks of the valve 25. The shanks of the valve 25 may have different dimensions.

The high pressure chamber 221 is provided with a gas inlet and the gas expansion chamber 26 is provided with a gas outlet.

When the air enters via the control chamber upstream portion 20, the control chamber 23 at a pressure $P_{d.a}$ (which is substantially the same as the pressure in the air expansion chamber 212 and in the air conduit 164) less than the pressure $P_{d.g}$ prevailing in the gas expansion chamber 222 (which is substantially the same at that of the gas conduit 162) ($P_{d.a}<P_{d.g}$), the varying member 24 moves or deforms in the direction from the gas expansion chamber 222 to the control chamber 23. The valve 25 is then forced by the stress member 271 to come into contact with the varying member 24, and moves towards the separation wall 26 at the most until its other shank comes and abuts against this separation wall 26 on the side of the high pressure gas chamber 221. The gas admission into the gas expansion chamber 222 is then reduced or cut off if the valve closes the orifice 26' of the separation wall 26, and the pressure $P_{d.g}$ decreases in the gas expansion chamber 222.

When the pressure $P_{d.a}$ prevailing in the control chamber 25 (which is substantially equal to that prevailing in the air expansion chamber 212 and in the air conduit 164) is larger than the pressure $P_{d.g}$ in the gas expansion chamber 222 (which is substantially the same as the one of the gas conduit 162), the varying member 24 moves or deforms in a direction from the control chamber 23 towards the gas expansion chamber 222. The varying member 24 then exerts stress on the valve 25 which acts on the stress member 271 by opposing the return force of the stress member 271. The valve 25 then moves out of the separation wall 26. If it was placed against the latter, it is therefore no longer in abutment against the separation wall 26 on the side of the high pressure gas chamber 221 and then frees the orifice 26'. The gas flow entering the gas expansion chamber 222 increases, which increases the pressure $P_{d.g}$ which prevails therein and the gas escapes through the outlet into the gas conduit 162.

The position of the varying member 24 depends on the pressures $P_{d.a}$, $P_{d.g}$ on either side of the varying member 24. Also the position of the valve 25 depends on the pressures $P_{d.a}$, $P_{d.g}$ on either side of the varying member 24.

With this first embodiment of the servocontrolled pressure regulator, it is possible to obtain gas pressure in the gas conduit 162 substantially equal to the compressed air pressure in the air conduit 164 ($P_{d.g}\approx P_{d.a}$).

Figure 2B:
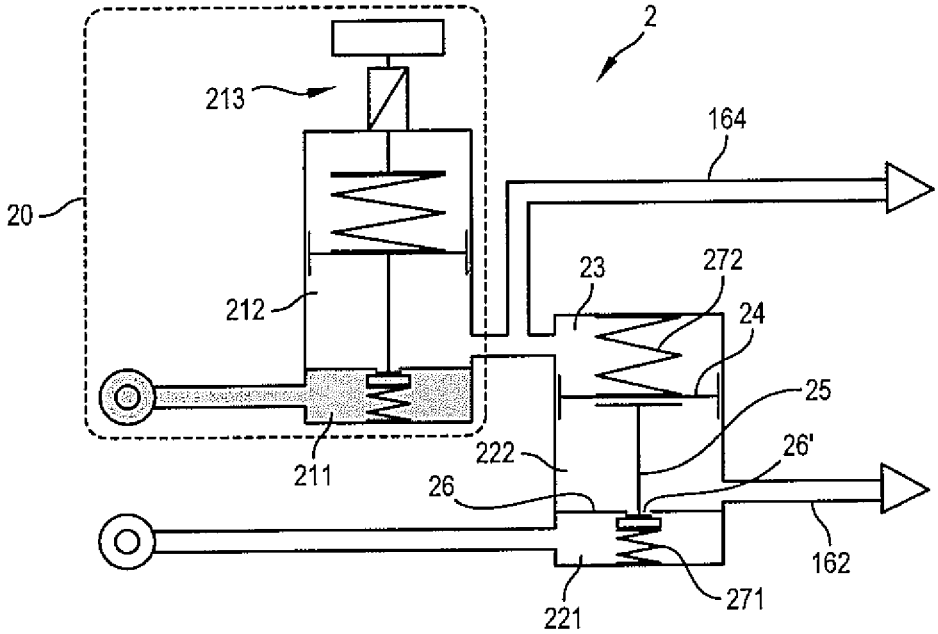

In a second embodiment of the servocontrolled pressure regulator 2 illustrated in FIG. 2*b*, an offset is added. i.e. the gas pressure $P_{d.g}$ in the gas conduit is always larger by a substantially constant amount, than the compressed air pressure $P_{d.a}$ in the air conduit ($P_{d.g}\approx P_{d.a}+\Delta P$).

In this second embodiment, a second stress member 272 acts on the varying member 24 in order to generate a constant positive offset $\Delta P$ relatively to the pressure $P_{d.a}$ prevailing in the control chamber 23.

For example, in the case when the second stress member 272 is a spring, it is positioned in the control chamber 23 so as to be supported on the varying member 24. The spring exerts a stress on the varying member 24 so as to force it towards the gas expansion chamber 222. The remainder of the servocontrolled pressure regulator 1 is identical with the first embodiment of the servocontrolled pressure regulator 1.

Figure 2C:
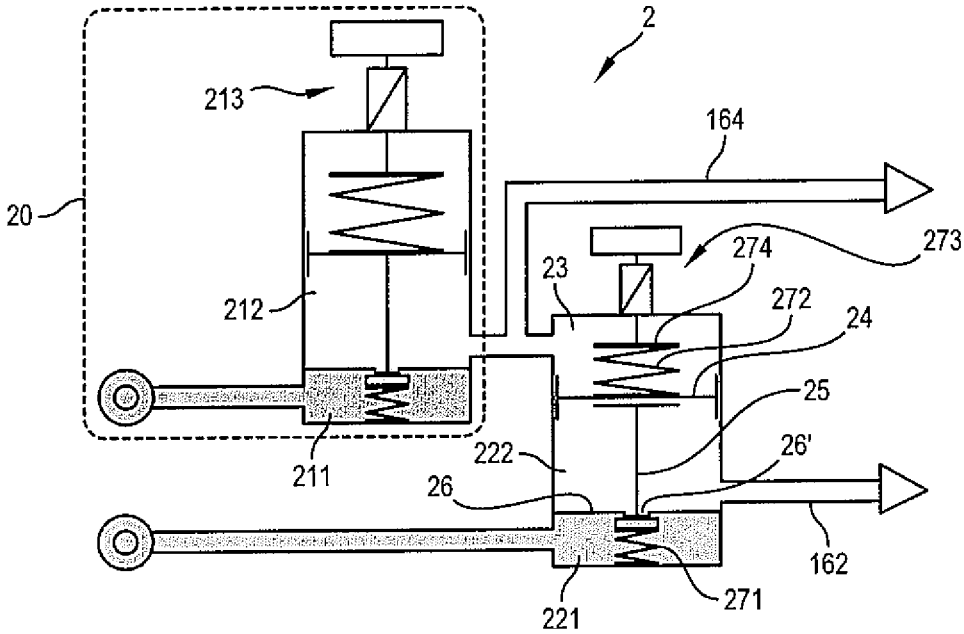

In a third embodiment, illustrated in FIG. 2*c*, the second stress member 272 always acts on the varying member 24 so as to generate a positive offset $\Delta P$ relatively to the pressure $P_{d.a}$ prevailing in the control chamber 23. However, in this embodiment, this positive offset $\Delta P$ is adjustable by adjustment means 274.

For example, in the case when the second stress member 272 is a spring, the latter is supported on the varying member 24, at one of its ends. At the other of its ends, the spring is supported on a plate 274 provided with a rod in its centre and extending on the side opposite to the spring. The rod may move with a reciprocal movement parallel to the spring by sliding or screwing. At the wall of the control chamber 25 opposite to the varying member 24, means for adjusting the plate 274 are provided with which the height z of this plate may be adjusted via its rod. The closer the plate 274 is to the varying member 24 and the larger is the offset. The farthest the plate 274 is away from the varying member 24, the smaller is the offset. The spring exerts a stress on the varying member 24 so as to force it towards the gas expansion chamber 222. The offset then depends upon the height z of the plate. The gas pressure in the gas expansion chamber 222 has the value: $P_{d.g}=P_{d.a}+\Delta P(z)$.

Figure 2D:
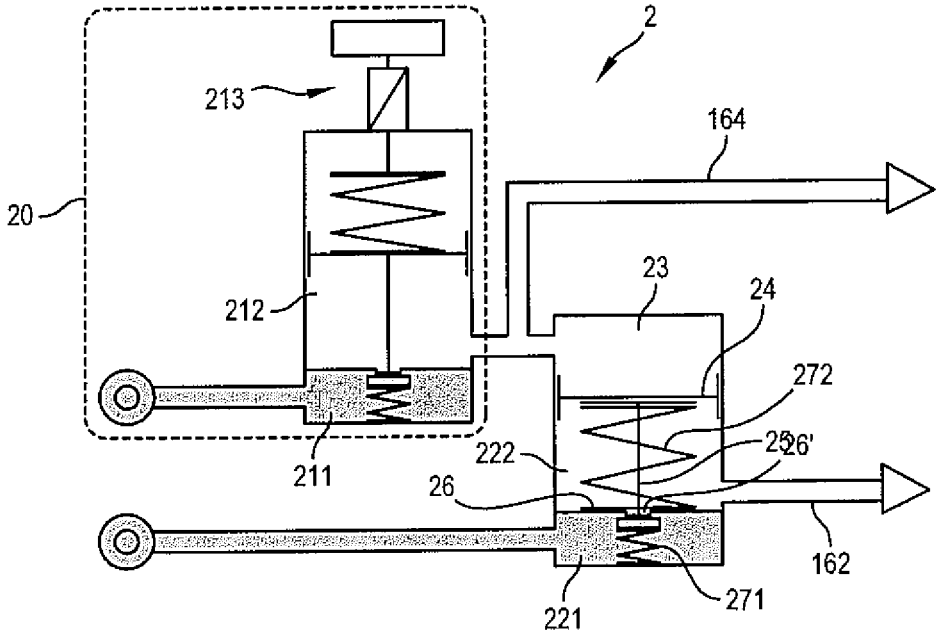
Figure 3:
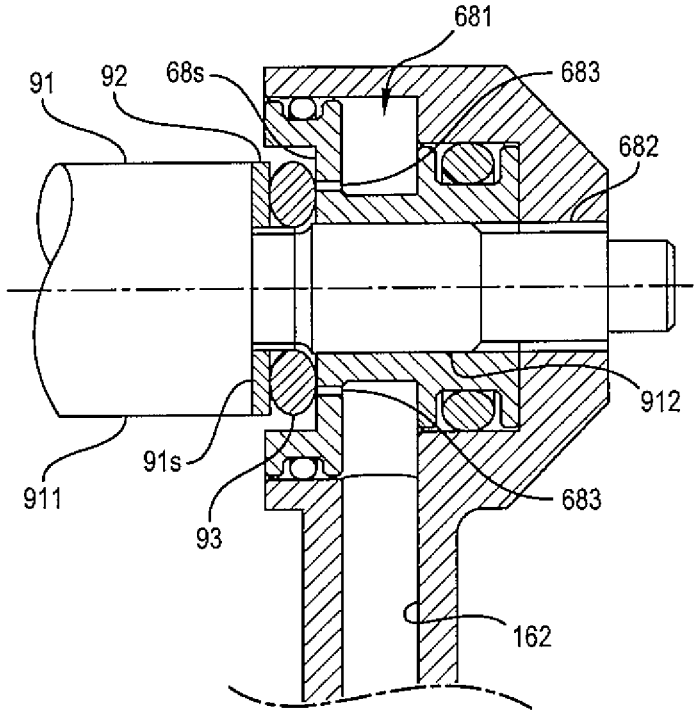
FIG. 3 is a schematic longitudinal sectional view of a gas injector used in the hot air generator according to the invention, illustrating a check of the seal of the gas circuit.

In a fourth embodiment, a negative offset may be generated. This embodiment is illustrated in FIG. 2*d*.

The general design of this embodiment is identical with the first embodiment, except for the addition of a second stress member 272 acting on the varying member 24 which enables a negative offset $-\Delta P$ to be obtained relatively to the pressure $P_{d.a}$ prevailing in the control chamber 23.

In the case when the second stress member 272 is a spring, the latter rests at one of its ends on the first shank of the valve 25 and at the other of its ends, on the separation wall 26 on the side of the gas expansion chamber 222. The second spring exerts a stress on the varying member 24 so as to force it towards the control chamber 23. The pressure prevailing in the gas expansion chamber $P_{d.g}$ substantially has the value $P_{d.a}-\Delta P$.

In these four embodiments of the servocontrolled pressure regulator 2, the gas supplied is under control of the compressed air supply which increases the safety of the hot air generator 1, since a gas supply without any provision of air is avoided.

The valve 25 may be designed differently from the description above and may have a different shape so as to be able to open or close the orifice 26' of the separation chamber 26 depending on the movements or deformations of the varying member 24.

Generally, the servocontrolled pressure regulator 2, may be used for applications other than a hot air generator. It may be used in all applications requiring a fluid to be controlled by another.

Ignition Means

Ignition means 128, for example a piezo-electric igniter, are positioned in the grip member 124 in contact with the actuation lever 122. A piezo-electric igniter 128 is known, for example from document EP 1 795 803 and will not be described in more detail in the following. An electrically conducting wire 8, in contact with the piezo-electric igniter extends right up to the flame generating means 6.

Flame Generating Means

The flame generating means 6, inside the nozzle 14, comprise a necked tube 62, a burner 64 and a gas injector 68 also forming a supporting upright for the burner 64.

The necked tube 62, having front and rear ends, has the shape of a straight cylinder with a generally circular base. The cross-section of the necked tube 62 is smaller than the cross-section of the nozzle 14. The cross-section of the necked tube 62 at the front end becomes slightly constricted. This narrowing 621 of the necked tube 62 enables the flame generated inside the latter to be contained, or in the vicinity of this narrowing 621. The distance between the narrowing 621 and the outlet end of the nozzle 14 is comprised between 2 and 8 times the diameter of the nozzle 14.

Alternatively, the tube 62 is not necked, i.e. it does not comprise any narrowing 621 at its front end. In this alternative, the flame is not contained inside the necked tube 62 and extends further forwards towards the outlet and of the nozzle 14.

The necked tube 62 has a same axis of revolution as the nozzle 14.

The burner 64 is held by the gas injector 68 relatively in the axis of the nozzle 14. It has a cylindrical rear portion 641 and a front portion 642 with the shape of a cone diverging towards the front portion. The rear portion 641 is bound to the injector 68 by being inserted into a bore 682 provided in the latter, and extends right up to the vicinity of the necked tube 62. The gas is ejected from the gas injector 68 through orifices 683 putting the space around the rear portion 641 of the burner 64 in fluid communication with the gas conduit 162. These orifices 683 are positioned so that the gas is ejected tangentially to the cylindrical rear portion 841 of the burner 64.

The centre of the burner 64 is crossed by a longitudinal bore 643 letting through the electrically conducting wire 8 in contact with the piezo-electric igniter 128. As for the gas, it passes around the burner 64 towards the inside of the necked tube 62.

The shape of the burner 64 enables the air and the gas to be mixed. Indeed, at the outlet of the gas injector 68, the gas flows tangentially to the rear portion 641 of the burner 64 and tends to adhere to the wall of the latter by carrying away air present in the surrounding portions by suction. This mixture of air and gas is also accelerated by the narrowing 621 of the cross-section towards the front of the nozzle 14.

At the widest portion of the cone forming the burner 64, there exists a cylindrical portion 644. The difference in section between the section comprised between the necked tube 62 and the cylindrical portion 644 of the burner 64 at the widest portion of the cone and the inner section of the necked tube 62 just after the front end of the burner 64 causes turbulent flow of the air and gas mixture which enables more homogeneous mixing of air and gas.

At the end of the cone-shaped portion 642 a central recess is provided so as to be used as a gas well 66. The gas well 66 receives through its bottom the electrically conducting wire 8 in contact with the piezo-electric igniter 128. The wire 8 is electrically insulated from the gas well 66. The potential difference between the walls of the well 66 and the wire 8 generated by the piezo-electric igniter 128 causes a spark which sets fire to the gas/air mixture contained in the well and in the necked tube 62. The generated flame is then fixed to the front surface of the burner and to the well. The air and gas mixture in the gas well 66 is renewed by turbulent flow of the mixture.

The necked tube 62 is used as a separation in order to obtain a mixture with the proper proportions of gas and air inside the necked tube 62 and the gas well 66.

A section $S_1$ delimited between the elongated nozzle 14 and the necked tube 62 and a section $S_2$ delimited between the necked tube 62 and the burner 64 give the possibility of acting on the mixture and on the temperature inside the nozzle 14.

Generally, the burner 64 is a burner with a stabilized flame which resists to an air draught, i.e. the flame remains fixed in the same location, for example a burner stabilized by a wake effect or a Coanda burner as described in the patent application filed under the European file number 08290820.3 or PCT 07/06419.

The presence of the necked tube 62 has several advantages. With this, i.a., it is possible to avoid overheating of the elongated nozzle 14 and to separate the airflow into two in order to guarantee clean combustion (i.e. with a correct proportion of gas and air so as to achieve total gas combustion). Indeed, the fact that a portion of the airflow is not heated enables cooling of the elongated nozzle 14. This also guarantees provision of fresh air for better combustion and for containing the flame inside the necked tube 62 and in the vicinity of the necked tube 62. This fresh air is heated in the vicinity of the narrowing 621 of the necked tube 62 and is projected out of the outlet end of the nozzle 14.

Operation

The hot air generator 1 according to the invention is set into operation by the operator when the latter, holding the handle 12, exerts pressure on the actuation lever 122. This pressure forces the actuation lever 122 to pivot around the low portion of the grip member 124 or to move translationally towards the grip member 124.

The displacement of the actuation lever 122 causes the opening of valves in the gas 162 and air 164 conduits thereby letting through the compressed air and the gas.

The compressed air then passes into the air conduit 164 before being injected by the air injector upstream from the venturi 4. The injection of compressed air through the venturi 4 causes suction of ambient air which enters through the rear end of the hot air generator 1. The ambient air then mixes with the compressed air at the venturi 4 and before a first fraction passes through the flame generator means 6. The other fraction then passes through the passage defined between the necked tube 62 and the elongated nozzle 14.

The gas passes into the gas conduit 162 before being injected by the gas injector 68 around the burner 64. The gas enters into the necked tube 62 with the first fraction of ambient air/compressed air mixture.

The well 66 is filled with gas and with ambient air/compressed air mixture.

The displacement of the actuation lever 122 causes a stress on the piezo-electric igniter 128 as described in document EP 1 795 803 which causes generation of a spark in the well 66 by the electrically insulated wire 8 of the gas well 66, setting fire to the gas/ambient air/compressed air mixture.

A flame is then produced in the necked tube 62 and propagates up to the vicinity of its narrowing 621.

The flame then heats the other fraction of the ambient air/compressed air mixture which has passed through the passage defined between the necked tube 62 and the elongated nozzle 14.

The heated ambient air/compressed air mixture then passes through the front portion 142 of the elongated nozzle 14 up to the outlet end of the nozzle 14. This ambient air/compressed air mixture may then be used for heating a material.

The air temperature at the outlet of the hot air generator is comprised between 300° C. and 1 000° C.

Checking the Seal of the Gas Circuit

The design of the hot air generator 1 as provided by the invention facilitates checking of the seal of the gas circuit.

Indeed, the gas injector 68 comprises an inner toric space 681 in fluid communication with the gas conduit 162. It also has a bore 682 for receiving the burner 64. The diameter of the bore 682 is smaller than the inner diameter of the toric space 681. The bore 682 and the toric space 681 have the same axis of revolution as the nozzle 14 and the necked tube 62.

On a front surface, turned towards the front of the nozzle 14, of the gas injector 68, are provided one or more orifices 683 passing between the outside and the inner toric space 681 of the injector 68. The gas flows out from through this/these orifice(s) 683. For example, the gas injector comprises several orifices 683. Further for example, the orifices 683 are four in number which may be regularly spaced out around the bore 682 or not.

For checking the sealing, a pin 91 is used. The pin 91 is an elongated axisymmetrical member, formed with at least two cylinders 911, 912 of different sections. Both of these cylinders 911, 912 may be added onto each other or made as a single part. At the interface between both cylinders 911, 912 of different sections, a supporting surface 91*s* is present on the cylinder 911 of largest section.

Upon checking the sealing of the gas circuit, the burner 64 is removed from the gas injector 68. The pin 91 is inserted in the place of the burner 64 through its portion of smallest section 912. A friction part 92 and an O-ring gasket 93 are placed between the supporting surface 91*s* and the front surface of the gas injector 68 so that the frictional part 92 is in contact with the supporting surface 91*s* on one side and with the O-ring gasket 93 on the other side. The O-ring gasket 93 is in contact with the front surface of the gas injector 68 so that it sealably blocks the orifice(s) 683 present on this front surface 68*s* when the pin 91 is forced towards the gas injector 68.

With the frictional part 92, it is possible to avoid rotation of the O-ring gasket 93 when it is in contact with the front surface 68*s* of the gas injector 68 while enabling the operator to turn the pin 91 upon its insertion into the gas injector 68. Indeed, since the front surface of the injector 68 has orifices 683 which are covered by the O-ring gasket 93, the latter may be deteriorated by friction if it rotates while being forced towards the front surface 68*s* of the gas injector 98.

The checking of the sealing is then carried out on the gas injector 68 while it is in its final configuration. Gas is injected into the gas circuit, in order to check that there are no leaks.

After the check, it will be sufficient for the operator to remove the pin 91, the friction part 92 and the O-ring gasket 93 and insert the burner 64 into the gas injector 68.

The invention claimed is:

1. A portable hot air generator comprising:

a handle comprising an igniter;

an elongated nozzle bound to the handle comprising an outlet end for ejecting hot air;

a flame generator inside the elongated nozzle;

a venturi upstream from the flame generator, formed on the elongated nozzle;

a gas conduit passing through the handle to bring a combustible gas into the elongated nozzle and at the flame generator, the gas conduit extending through the handle and up to the flame generator;

an air conduit passing through the handle to bring compressed air into the elongated nozzle and upstream from the venturi;

a servocontrolled pressure regulator controlling a gas pressure in the gas conduit depending on air pressure in the air conduit; and wherein the flame generator comprises a tube, a burner and a gas injector each placed within the nozzle, the tube being positioned at least partly around the burner for cutting a flow of fresh air into two.

2. The generator according to claim 1, wherein the tube is a necked tube, a section of the necked tube being narrowed at its portion closest to the outlet end of the nozzle.

3. The generator according to claim 1, wherein the gas injector comprises a bore, having the same axis as the nozzle, for inserting the burner and at least one orifice through which the gas flows out, this/these orifice s) being positioned so that the gas flows out tangentially to the burner.

4. The generator according to claim 1, wherein the burner is a burner with a stabilized flame, wherein the generated flame remains fixed in the same location.

5. The generator according to claim 4, wherein the burner with a stabilized flame is either a burner stabilized by a wake effect or a Coanda burner.

6. The generator according to claim 1, wherein the igniter is a piezo-electric igniter coupled to an electrically conducting wire in contact with it and which extends up to the flame generator.

7. The generator according to claim 1, wherein the servocontrolled pressure regulator comprises a control chamber in fluid communication with the air conduit and downstream from an air expansion chamber, a high pressure gas chamber, and a gas expansion chamber in fluid communication with the gas conduit, wherein the control chamber is separated from the gas expansion chamber by a varying member moving or deforming in response to a pressure difference between a pressure prevailing in the control chamber and a pressure prevailing in the gas expansion chamber, a first stress member opposing the displacement or deformation of the varying member when the latter moves or deforms towards the gas expansion chamber.

8. The generator according to claim 7, wherein the varying member is a disc moving translationally in response to the pressure difference between the pressure prevailing in the control chamber and the pressure prevailing in the gas expansion chamber, the disc having on its edges an O-ring gasket with which sealing between the control chamber and the gas expansion chamber may be ensured.

9. The generator according to claim 7, wherein the varying member is a membrane which deforms in response to the pressure difference between the pressure ($P_{d,a}$) prevailing in the control chamber and the pressure ($P_{d,g}$) prevailing in the gas expansion chamber, the membrane having sealably fixed edges on a wall of the control chamber and the gas expansion chamber.

10. The generator according to claim 7, wherein the servo-controlled pressure regulator further comprises a second stress member suitable for generating a pressure offset between the pressure prevailing in the control chamber and the pressure prevailing in the gas expansion chamber.

11. The generator according to claim 10, wherein the second stress member is a second spring provided in the control chamber and intended to generate an offset so that the gas pressure in the gas conduit is always larger by a substantially constant amount than the air pressure in the air conduit.

12. The generator according to claim 11, wherein the second spring has a supporting point with fixed height in the control chamber and is intended for generating a substantially constant offset.

13. The generator according to claim 11, wherein the second spring has a supporting point of variable height in the control chamber and is intended for generating a variable offset.

14. The generator according to claim 10, wherein the second stress member is a second spring provided in the gas expansion chamber and intended for generating an offset so that the gas pressure in the gas conduit is always less by a substantially constant amount than the air pressure in the air conduit.

15. The generator according to claim 1, wherein the gas injector further comprises an inner toric space in fluid communication with the gas conduit, the inner diameter of which is larger than the diameter of the bore, one or more through-orifices putting the toric space in fluid communication with the inside of the nozzle, on a surface facing the outlet end of the nozzle, the bore, the toric space and the nozzle substantially having the same axis.

* * * * *